US007802619B2

(12) United States Patent
Hurst et al.

(10) Patent No.: US 7,802,619 B2
(45) Date of Patent: Sep. 28, 2010

(54) FIRING TRIGGER APPARATUS AND METHOD FOR DOWNHOLE TOOLS

(75) Inventors: Brian W. Hurst, Mineral Wells, TX (US); John L. Marshall, Arlington, TX (US); David S. Wesson, Granbury, TX (US)

(73) Assignee: Probe Technology Services, INc., Forth Worth, TX (US)

( * ) Notice: Subject to any disclaimer, the term of this patent is extended or adjusted under 35 U.S.C. 154(b) by 204 days.

(21) Appl. No.: 12/231,469

(22) Filed: Sep. 3, 2008

(65) Prior Publication Data

US 2010/0051265 A1 Mar. 4, 2010

(51) Int. Cl.
*E21B 29/02* (2006.01)
*E21B 43/1185* (2006.01)

(52) U.S. Cl. ..... 166/63; 166/299; 166/250.01

(58) Field of Classification Search ..... 102/313, 102/312; 166/63, 299, 376, 250.01
See application file for complete search history.

(56) References Cited

U.S. PATENT DOCUMENTS 3,045,748 A * 7/1962 Schramm ..... 175/4.51
4,660,638 A * 4/1987 Yates, Jr. ..... 340/853.9
5,369,579 A * 11/1994 Anderson ..... 702/11
6,105,688 A 8/2000 Vaynshteyn et al.
6,273,187 B1 * 8/2001 Voisin et al. ..... 166/63
7,152,680 B2 * 12/2006 Wilson et al. ..... 166/298

* cited by examiner

*Primary Examiner*—Kenneth Thompson
(74) *Attorney, Agent, or Firm*—Jackson Walker L.L.P.

(57) ABSTRACT

Methods and devices are provided for controlling detonation of explosives in a well bore for perforation or a well bore casing, which avoid or reduce unintentional or undesirable detonations while ensuring or increasing desirable detonations. An explosive trigger system or tool may comprise a central processing unit (CPU), memory, and one or more sensors disposed for measuring one or more downhole conditions. Downhole conditions may be measured with the sensor and then used to program detonation parameters (such as temperature or pressure) or preconditions (such as time or distance traveled) to the trigger system. Detonation can only occur when the programmed parameters or preconditions are satisfied. In this way, undesirable detonations are avoided by requiring certain preconditions to arming the trigger system. To further control arming and/or detonating, a line sequencer may be provided, wherein energy is propagate down along the physical deployment line as pulses or line "jerks" through mechanical manipulations of physical deployment line near surface. These pulses can form signals for downhole control of the trigger system.

52 Claims, 2 Drawing Sheets

FIRING TRIGGER APPARATUS AND METHOD FOR DOWNHOLE TOOLS

BACKGROUND

The present invention relates to the field of hydrocarbon production, and more particularly to the triggering of explosive devices in well bores to perforate well casings, set packers, and accomplish other work. Most particularly, the invention relates to a method and apparatus for the control of downhole explosive devices utilizing a physical structure such as a slickline, wireline, tool string, or conduit to transmit non-electrical control signals to a explosive device positioned in the wellbore.

In oil and gas exploration and production operations, well bores are drilled into the ground to gain access to subsurface hydrocarbon-bearing formations or reservoirs. The well bores are typically lined with steel tubing, known as casing or liner, to provide the wellbore with a stable, permanent barrier. This casing is often secured by cement that is pumped into the annulus between the outside diameter of the casing and the inside diameter of the wellbore wall.

While the casing stabilizes the wellbore wall, it also seals the fluids within the earth strata. Thus, the casing must be opened in order to allow inflow of hydrocarbons into the casing for extraction. To selectively open the casing to such fluid flow, the casing wall is often penetrated in the region of a fluid production zone by shaped or oriented charge explosives, which when detonated, penetrate the casing creating perforations through which fluid in the formation may flow. The tubular tool section that carries these explosives is often referred to as a "perforation gun" or more simply as a "gun."

By traditional prior art procedure, the tubular gun may be releasably attached to the end of a wireline or coiled tube for running into the well. When the gun has been positioned at the desired depth, the gun may be secured in place and "armed" for firing.

The use of explosives for these various downhole purposes has certain drawbacks. Explosive devices positioned within a wellbore which fail to fire or for some reason are not fired must be retrieved from the wellbore in its unfired condition, creating a potential hazard to both personnel and the wellbore. Likewise, inadvertent firing of an explosive device or self-detonation of an explosive device downhole while the gun is being positioned or retrieved can damage the wellbore, such as perforating the casing at an undesired depth.

Thus, it is common to utilize some type of mechanism to arm and/or fire the gun. For example, hydraulic manipulation of mechanical components of the tubular string is often used to trigger or fire such guns. The prior art further includes downhole triggering/firing control devices that are operable by pressure, time or motion, e.g., a line jerk, referring to a sharp jolt or jerk of the downhole device. Frequently, to ensure that a gun is not triggered at the wrong depth (such as during deployment), information is programmed into the triggering device based on the expected firing parameters at a desired position so that the triggering device becomes operable only when the expected parameter, such as depth, pressure, or temperature at the device, is satisfied.

There is a need for a downhole triggering system that can reliably prevent accidental or unintended detonation of a perforating gun and at the same time operate reliably when intended to operate.

It is desirable to provide a triggering system that allows complete depth control and triggering in an integrated system and avoids the likelihood of a triggering device programmed with incorrect triggering parameters. Such a device should permit the gun to be fired only under predictable circumstances.

It is further desirable to provide a system that operates in real time. By utilizing a real time clock onboard the trigger mechanism, the operator can more easily synchronize the operations of the downhole trigger with the operations on the surface. Heretofore, no such trigger mechanism includes a real time clock for operation.

Finally, it also desirable to provide a system that permits surface communication with the downhole trigger device without reliance on electrical communications or a "line jerk."

BRIEF SUMMARY OF INVENTION

The present invention relates to the field of hydrocarbon production, and more particularly to the triggering of explosive devices in well bores to perforate well casings, set packers, and accomplish other work. Most particularly, the invention relates to a method and apparatus for the control of downhole explosive devices utilizing a physical structure such as a slickline, wireline, tool string, or conduit to transmit non-electrical control signals to a explosive device positioned in the wellbore.

One example of a method for controlling detonation of explosives in a well bore comprises the steps of: providing a trigger system having a central processing unit (CPU), memory, and at least one sensor disposed for measuring at least one downhole condition; running said trigger system into the well bore and measuring at least one downhole condition; recording the downhole condition in said memory; withdrawing the trigger system and programming detonation parameters into the CPU based on the measured downhole conditions; attaching a detonator to the trigger system; running the detonator and trigger system into the well bore on a physical deployment line; measuring downhole conditions adjacent the detonator and trigger system; and arming the detonator once the measuring downhole conditions adjacent the detonator and trigger system fall within the programmed detonation parameters.

One example of a method for controlling detonation of explosives in a well bore comprises the steps of: providing a trigger system having a central processing unit (CPU), memory and at least one sensor disposed for measuring at least one downhole condition; running a sensor into the well bore and measuring at least one downhole condition at a desired location of perforation; withdrawing the sensor; programming detonation parameters into the CPU based on the measured downhole condition; attaching a detonator to the trigger system; running the detonator and trigger system into the well bore on a physical deployment line; measuring downhole conditions adjacent the detonator and trigger system; and arming the detonator once the measuring downhole conditions adjacent the detonator and trigger system fall within the programmed detonation parameters.

One example of a blasting control system for controlling initiation of downhole explosive induced activity within a well bore comprises: a central processing unit (CPU) being electronically coupled to an electronically fired detonator; a first battery having a first voltage and powering said CPU; a real time clock powered by said first battery and coupled with said CPU; a sensor circuit being electronically coupled with said CPU and being adapted for sensing a condition in the well bore; non-volatile memory capable of storing said sensed condition, wherein said non-volatile memory is coupled to said CPU; a second battery having a second voltage greater than said first voltage; and wherein the CPU is programmed to record a sensed condition in the wellbore at a first time and subsequently monitor for said sensed condition at a later second time and upon detection of said sensed condition at the second time, causing said second battery to be electronically coupled to said detonator.

One example of a method for controlling detonation of explosives in a well bore comprises the steps of: a. providing a trigger system having a central processing unit (CPU), memory and at least one sensor disposed for measuring at least one downhole condition; b. running said trigger system into the well bore and measuring at least one downhole condition at a desired location of perforation; c. measuring the time required to run the trigger system from a first reference point to a second reference point, wherein the sensor is positioned adjacent the desired location of perforation when the triggering system is at said second reference point; d. withdrawing the trigger system and programming a detonation time window into the CPU based on the measured time; e. attaching a detonator to the trigger system; f. running the detonator and trigger system into the well bore; g. during the step of running the detonator and trigger system into the well bore, measuring the time from the first reference point to the second reference point; and h. arming the detonator only after a period of time has elapsed during step g that is at least equal to or longer than the measured time of step c.

One example of a method for controlling detonation of explosives in a well bore comprises the steps of: a. providing a trigger system having a central processing unit (CPU), memory and at least one sensor disposed for measuring at least one downhole condition; b. running a sensor into the well bore and measuring at least one downhole condition at the desired location of perforation; c. as the sensor is being run into the well, measuring a reference time between a first reference point and a second reference point, wherein the sensor is positioned adjacent the desired location of perforation at said second reference point; d. withdrawing the sensor and programming a detonation time window into the CPU based on the measured reference time; e. attaching a detonator to the trigger system; f. running the detonator and trigger system into the well bore; g. during the step of running the detonator and trigger system into the well bore, measuring the time from the first reference point to the second reference point; and h. arming the detonator only after a period of time has elapsed during step g that is at least equal to or longer than the measured time during step c.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 2A:
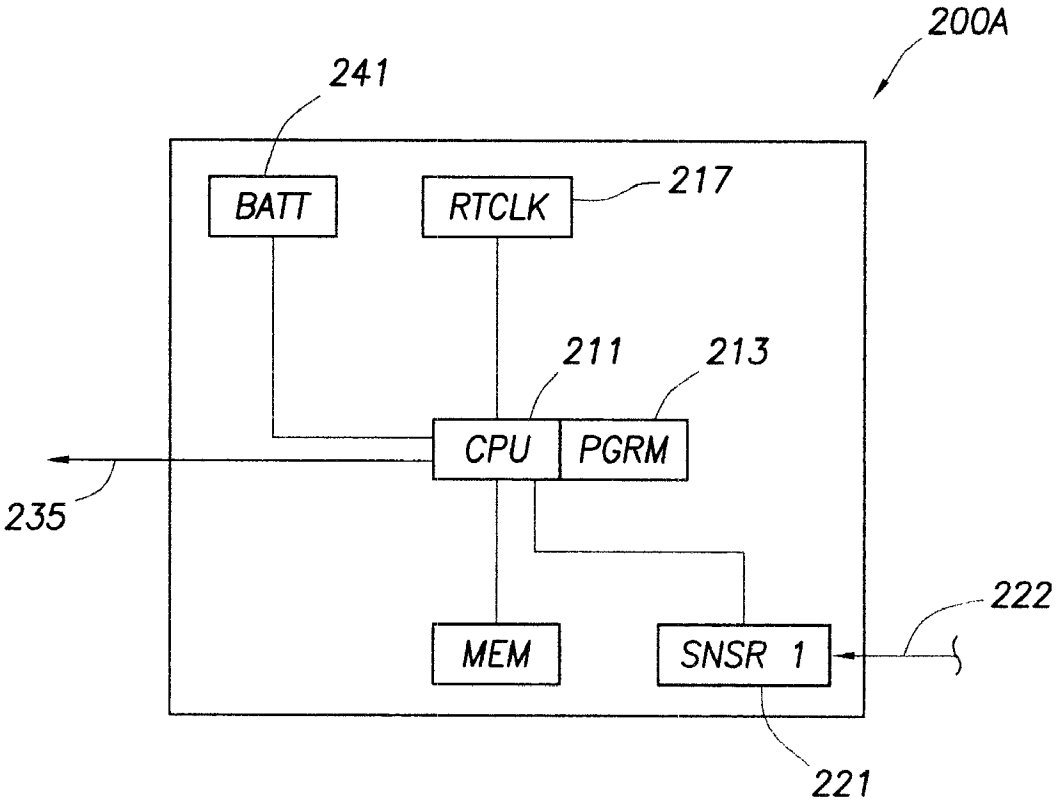
FIG. 2A illustrates a schematic diagram of one embodiment of a trigger device.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

The present invention relates to the field of hydrocarbon production, and more particularly to the triggering of explosive devices in well bores to perforate well casings, set packers, and accomplish other work. Most particularly, the invention relates to methods and apparatus for the control of downhole explosive devices utilizing a physical structure such as a slickline, wireline, tool string, or conduit to transmit non-electrical control signals to a explosive device positioned in the wellbore.

In certain embodiments, explosive trigger systems of the present invention may comprise a central processing unit (CPU), memory, and one or more sensors disposed for measuring one or more downhole conditions. Downhole conditions may be measured with a sensor and then used to provide detonation parameters or preconditions to the trigger system. In this way, undesirable detonations are avoided by requiring certain preconditions to arming the trigger system. Optional embodiments may include a real-time clock which may be used to provide one or more of the required preconditions to arming the device. Additionally, an arming battery may be provided, power from which is required to arm the trigger system. Methods are also provided. In this way, unintentional or undesirable detonations are avoided or reduced while ensuring or increasing desirable detonations at the preferred downhole locations.

To facilitate a better understanding of the present invention, the following examples of certain embodiments are given. In no way should the following examples be read to limit, or define, the scope of the invention.

Figure 1:
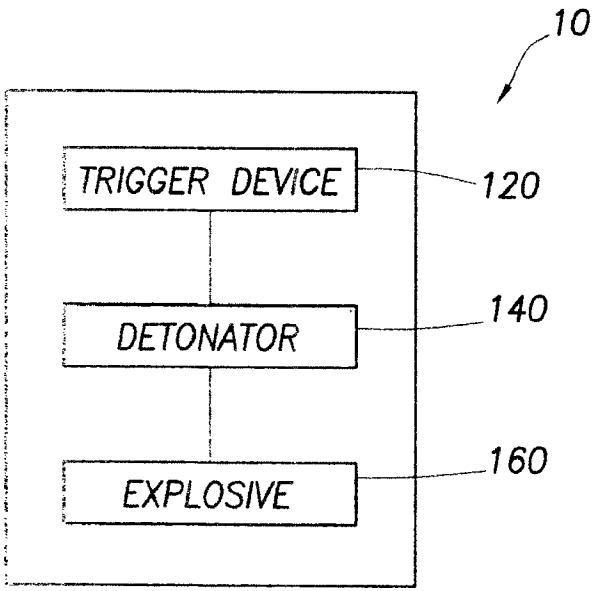
FIG. 1 illustrates a schematic diagram of one embodiment of a perforation gun.

FIG. 1 illustrates a schematic diagram of one embodiment of a perforation gun.

Blasting control system 100, sometimes referred to as a perforation gun, comprises trigger device 120, detonator 140, and explosive 160. Trigger device 120 is a control circuit that transmits an activation or trigger signal to detonator 140. Detonator 140 in turn activates explosive 160. As will be explained further below, trigger device 120 is preferably designed to provide an activation signal only at a desired wellbore depth. Undesirable early activation signals by trigger device 100 are avoided through a combination of protective features described in more detail below.

Explosive 160 may be shaped or oriented explosives to produce the desired perforation pattern in a wellbore casing. Explosive 160 may comprise one or more explosives or explosive charges.

FIG. 2A illustrates a schematic diagram of one embodiment of a trigger device.

In one embodiment, trigger device 200A comprises CPU 211 operable with software instructions 213, sensor 221 for measuring one or more downhole conditions, memory 215 for storing data including measured downhole conditions, real-time clock 217, and battery 241. In this embodiment, CPU 211 provides an activation signal 235 to a detonator (not shown) based on a set of desired criteria.

Sensor 221, having sensor input 222, is any sensor suitable to measure or infer one or more downhole conditions, including, but not limited to, pressure, temperature, electromagnetic radiation including gamma radiation, number of casing collars traversed, acceleration, orientation, inclination, depth, application of external force, time (real time or relative time) or any combination thereof. In certain embodiments, sensor 221 comprises an accelerometer, a load cell, magnetic measurement devices, or any combination thereof. Sensor 221 may further comprise its own independent power source such as a battery or alternatively may be powered by battery 241.

Real-time clock 217 is communicatively coupled to CPU 211. Real-time clock 217 may be used to determine any desired passage of time by CPU 211 including, but not limited to, a duration of time, travel time of trigger device 200A from one reference point to a second reference point, resting time of the trigger device 200A, reference time stamps associated with sensor data, or any combination thereof.

Memory 215 may be used to store any suitable data, including, but not limited to, measured sensor data, time data, intermediate or final calculations of CPU 211, or any combination thereof. Additionally, software instructions 213 may optionally be stored in a portion of memory 215. In certain embodiments, memory 215 may comprise volatile memory, non-volatile memory, or any combination thereof, including, but not limited to flash memory. In certain embodiments, memory 215 is capable of receiving and storing many thousands of well data sets, including time data and any other sensor data, including data measured before, during, or after a detonation.

Again, as will be explained further below, CPU 211 is operable to provide activation signal 235 under a set of predetermined criteria.

While not intended to be limiting in any way, the following more detailed examples of various possible parameters are provided:

Pipe tally log may measure the number of pipes, collars or some other downhole repetitive structure traversed along the length of the wellbore. A pipe tally is a list of the order of pipe joints in a well and their associate specific length of each. In one embodiment, the system stores the tally and then using the CCL or a GMR (Giant Magneto Resistive Device), can compare the pipe lengths to the tally. The tool can then compare and verify the position as a selected parameter (meaning the tool would use these matching parameters to either arm or remain disarmed).

The tool may include a three axis accelerometer. The accelerometer can be used to determine inclination of the tool. This may be particularly useful in horizontal drilling. Again, arming or disarming can occur based on inclination of the tool.

The tool can count gamma rays in a manner well known in the industry, and utilize the gamma ray count to arm or disarm the tool.

The three axis accelerometer may also be used to measure depth of the tool, such that depth can be the parameter utilized to arm or disarm the tool.

Figure 2B:
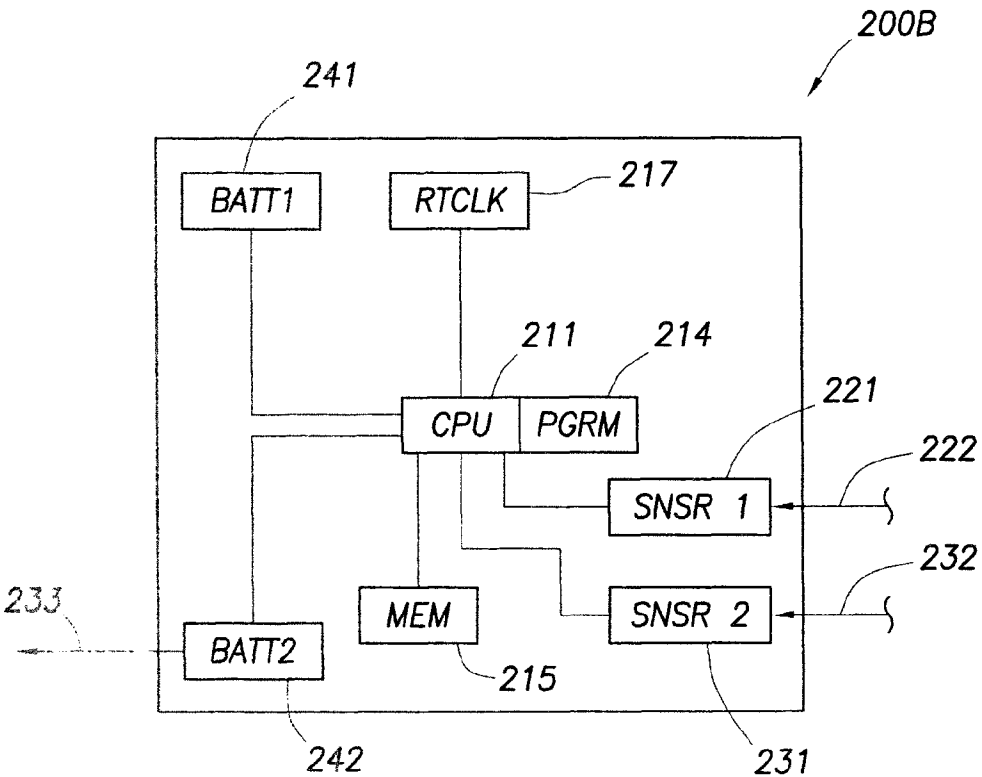
FIG. 2B illustrates a schematic diagram of another embodiment of a trigger device.

FIG. 2B illustrates a schematic diagram of another embodiment of a trigger device.

Trigger device 200B comprises CPU 211 operable with software instructions 214, first sensor 221, second sensor 231, memory 215, real-time clock 217, first battery 241 for supplying power to CPU 211, and second battery 242 for activating a detonator (not shown).

Second sensor 231 measures one or more downhole conditions, which may overlap or be exclusive of the one or more downhole conditions measure by first sensor 221. In certain embodiments, second sensor 231 is a sensor identical to first sensor 221 provided for redundancy purposes. In other embodiments, second sensor 231 may be a load cell or other device suitable for detecting energy waves propagated along a physical deployment line upon which trigger device 200B is suspended in a wellbore. Of course, as with first sensor 221, second sensor 231 could be any sensor suitable to measure or infer one or more downhole conditions, including, but not limited to, pressure, temperature, electromagnetic radiation including gamma radiation, number of casing collars traversed, acceleration, orientation, inclination, depth, application of external force, time, or any combination thereof. Although trigger device 200B is depicted with two sensors, it is recognized that any number of sensors may be used in conjunction with trigger device 200B.

As before, CPU 211 determines, based on a set of predetermined criteria, when to provide a detonation activation signal. In this case, however, CPU 211 does not provide this detonation activation signal directly to a detonator. Instead, CPU 211 allows second battery 242 to provide activation power to a detonation device (not shown). Normally, second battery 242 is shunted or otherwise electrically isolated from the detonation device. In certain embodiments, a signal to a relay may provide the mechanism by which power is completed to the detonation device.

First battery 241 is a low power energy source for providing power to CPU 241. As an additional safety feature, the power supplied by first battery 241 is insufficient to activate the detonation device.

As will be further apparent in the following description, the components of the trigger devices of FIGS. 2A and 2B may interact and be used to provide a variety of functionality useful for avoiding or reducing unintentional or undesirable detonations and ensuring or increasing desirable detonations at desired wellbore locations.

Figure 3:
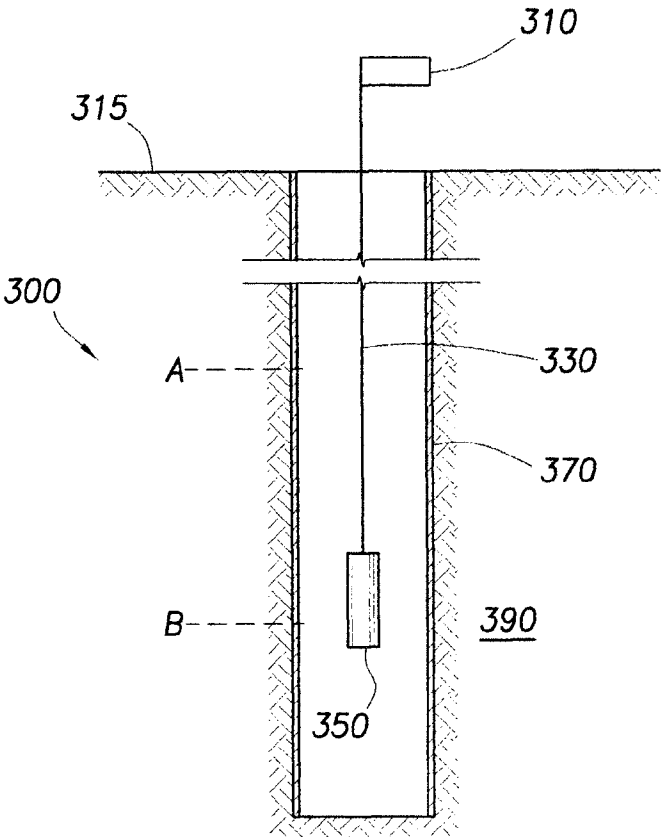
FIG. 3 illustrates a cross-sectional side view of one embodiment of a trigger system 350 disposed in a completed wellbore.

FIG. 3 illustrates a cross-sectional side view of one embodiment of a trigger system 350 disposed in a completed wellbore.

Casing 370 is disposed in a wellbore in formation 390.

Trigger system 350 is suspended in casing 370 by physical deployment line 330. Physical deployment line 330 may be any longitudinal length suitable for lowering or raising trigger system 350 in the length of casing 370, including, but not limited to, a slickline, a wireline, a tool string, a cable, a non-conducting wire, a conduit including a plurality of pipe joints, or any combination thereof.

The methods of the present invention may involve one or more trips of trigger system 350 down casing 370. The elements included in trigger system 350 may vary depending on the configuration of each particular embodiment. For example, in certain embodiments, trigger system 350 may comprise the elements of FIG. 1, the elements of FIG. 2A, the elements of FIG. 2B, or any combination or subset thereof depending on the desired application.

In one method, trigger system 350 measures downhole conditions in a first trip and perforates the casing in a second trip. To illustrate one embodiment of this method, reference will be made to FIG. 3, assuming trigger system 350 comprises a trigger device of FIG. 2B (CPU 211 operable with software instructions 214, memory for storing data 215, first sensor 221, second sensor 231, real-time clock 217 coupled to CPU 211, first battery 241 for powering CPU 211 and/or sensor 221, and second battery 242 coupled to CPU 211 for activating a detonation device).

In the first trip, trigger system 350 is lowered down casing 370. As trigger system 350 is lowered down casing 370, sensor 221 of trigger system 350 measures one or more downhole conditions. Trigger system 350 may be lowered down casing 370 by any suitable device including, but not limited to a slickline winch. As trigger system is lowered down casing 370, CPU 211 receives data from sensor 221 and stores it in memory 215 for later retrieval. The stored data in memory 215 provides a profile of the downhole conditions versus depth in the wellbore.

After measuring and recording one or more downhole conditions in a length of interest in the wellbore, trigger system 350 may be withdrawn and then, detonation parameters may be programmed into the trigger system based on the downhole conditions measured. That is, the measured downhole conditions provide a basis for programming the detonation parameters of trigger system 350. Once the desired detonation parameters are known and programmed into trigger system 350, additional elements may be added to trigger system 350, including, but not limited to a detonation device, one or more explosives, a second battery, or a combination thereof. By not including a detonation device and/or explosive during the first trip of trigger system 350, undesirable unintended activations of trigger system 350 are avoided.

In one embodiment, the detonation parameter(s) forms a "threshold" that must be satisfied, crossed or achieved before detonation can occur. In other words, detonation can only occur if the condition measured during the perforating trip down the wellbore crosses the threshold.

In an alternative embodiment, a set of parameters may be programmed, in the form of an upper and lower parameter for a given downhole condition. This upper and lower parameter form a detonation "window", wherein detonation can only occur if the condition measured during the perforating trip down the wellbore falls within the window.

Now that trigger system 350 includes the elements necessary to perforate casing 370, trigger system 350 may be lowered down casing 370. Once the measured parameters fall within the programmed detonation parameters, trigger system 350 may be armed. Alternatively, such arming may be programmed to occur on the trip back up to the surface after passing through a zone of desired perforation.

The terms "arming," and variations thereof, as used herein, refers to removing one or more conditions that prevent the activation of the detonation device of trigger system 350, including, but not limited to, the electrical coupling of second battery 231 to the detonation device, providing a signal from CPU 211 to the detonation device, or a combination thereof.

The detonation parameters may include one or more measured downhole conditions including, but not limited to pressure, temperature, electromagnetic radiation including gamma radiation, number of casing collars traversed, acceleration, inclination, depth, orientation, application of external force, travel time of trigger system 350, resting time of trigger system 350, time traveled by trigger system 350 from one reference point to a second reference point, real time based on synchronization with a control clock or any combination thereof. For example, preconditions to arming the detonation device of trigger system 350 may include reaching a certain pressure and temperature, reaching a certain depth as measured by the number of casing collars traversed and a certain temperature, etc. In this way, premature detonation of trigger system 350 may be avoided.

Alternatively or in addition to the aforementioned detonation parameters, controlled line sequencer 310 may be used to provide one or more preconditions to the arming of trigger system 350. Controlled line sequencer 310 may be any device suitable for inducing energy that propagates along physical deployment line 330, including energy applied through mechanical manipulations of physical deployment line 330 near surface 315. Controlled line sequencer 310 may induce propagated energy waves along physical deployment line 330 in an automated fashion so as to communicate with trigger system 350. Propagated energy waves may be varied in any suitable fashion so as to provide information to trigger system 350, including, but not limited to, variations in frequency modulation, amplitude modulation, phase modulation, variations in acceleration of vertical movement of physical deployment line 330, or any combination thereof. In one embodiment, controlled line sequencer 310 is a winch, such as the slickline wench, coupled to a solenoid, camshaft ("CAM") or similar device that can be used to generate pulses. The trigger would then fire assuming all other "threshold" or "window" parameters have been met.

In this way, controlled line sequencer 310 may communicate with trigger system 350 conveying a unique code or a complex series of propagated energy waves. One of the sensors of trigger system 350 may be configured to detect and decode a control signal from the surface from the series of propagated energy waves sent by controlled line sequencer 310. One or more of these propagated energy waves may constitute a control signal to trigger system 350, which may further include an arming or firing signal to trigger system 350.

In this way, unintentional or accidental detonations are avoided or further reduced.

In certain embodiments, one or more preconditions for arming trigger system 350 includes a duration of time, travel time of trigger device 200A from one reference point (e.g. reference point A of FIG. 3) to a second reference point (e.g. reference point B of FIG. 3), a resting time of the trigger device 200A, reference time stamps associated with sensor data, or any combination thereof. These preconditions to arming trigger system 350 may be in addition to or instead of any other arming preconditions described herein.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A method for controlling detonation of explosives in a well bore, said method comprising the steps of:

a. providing a trigger system having a central processing unit (CPU), memory, and at least one sensor disposed for measuring at least one downhole condition;

b. running said trigger system into the well bore and measuring at least one downhole condition;

c. recording the downhole condition in said memory;

d. withdrawing the trigger system and programming detonation parameters into the CPU based on the measured downhole conditions;

e. attaching a detonator to the trigger system;

f. running the detonator and trigger system into the well bore on a physical deployment line;

g. measuring downhole conditions adjacent the detonator and trigger system; and h. arming the detonator once the measuring downhole conditions adjacent the detonator and trigger system fall within the programmed detonation parameters.

2. The method of claim 1, wherein the detonator and trigger system are tun into the wellbore on a physical deployment line, and further comprising the step of propagating an energy wave down the physical deployment line and detecting the propagated energy adjacent the trigger system.

3. The method of claim 2, wherein arming occurs only after the propagated energy has been detected.

4. The method of claim 2, wherein the propagated energy is transmitted as discreet shockwaves that represent a control signal.

5. The method of claim 4, wherein the control signal provides control instruction to the CPU.

6. The method of claim 5, wherein said control instruction is a firing signal and said detonator is fired following receipt of the firing signal by the CPU.

7. The method of claim 1, wherein the detonator and trigger system are run into the wellbore on a physical deployment line, and further comprising the step of propagating a series of energy waves down the physical deployment line and detecting said propagated series of energy waves adjacent the trigger system.

8. The method of claim 7, wherein said propagated series of energy waves vary in frequency, amplitude, phase modulation, acceleration, or a combination thereof so as to represent a control signal to the CPU.

9. The method of claim 1, wherein said measured downhole condition is temperature.

10. The method of claim 1, wherein said measured downhole condition is pressure.

11. The method of claim 1, wherein said measured downhole condition is gamma ray energy.

12. The method of claim 1, wherein said downhole conditions are determined at the desired location of perforation.

13. The method of claim 1, wherein at least two downhole conditions are measured at the desired location of perforation.

14. The method of claim 1, wherein step b includes the measuring of the time required to run the system into the wellbore until a desired location of perforation has been reached.

15. The method of claim 14, wherein the step of arming the detonator occurs only once the a period of time has elapsed during step f that is at least equal to or longer than the measured time of running said trigger system into the well bore of step b.

16. The method of claim 5, wherein said control instruction is an arming signal and said detonator is armed for firing following receipt of the arming signal by the CPU.

17. The method of claim 1, further comprising the steps of monitoring the motion of the detonator and trigger system as they are run into the well bore and arming the detonator only once the motion of the detonator and trigger system has stopped for a predetermined time.

18. The method of claim 1, further comprising the steps of monitoring the motion of the detonator and trigger system as they are run into the well bore and arming the detonator only once the motion of the detonator and trigger system has stopped for a predetermined time.

19. A method for controlling detonation of explosives in a well bore, said method comprising the steps of:

a. providing a trigger system having a central processing unit (CPU), memory and at least one sensor disposed for measuring at least one downhole condition;

b. running a sensor into the well bore and measuring at least one downhole condition at a desired location of perforation;

c. withdrawing the sensor;

d. programming detonation parameters into the CPU based on the measured downhole condition;

e. attaching a detonator to the trigger system;

f. running the detonator and trigger system into the well bore on a physical deployment line;

g. measuring downhole conditions adjacent the detonator and trigger system; and h. arming the detonator once the measuring downhole conditions adjacent the detonator and trigger system fall within the programmed detonation parameters.

20. A blasting control system for controlling initiation of downhole explosive induced activity within a well bore, said system comprising:

a. a central processing unit (CPU) being electronically coupled to an electronically fired detonator;

b. a first battery having a first voltage and powering said CPU;

c. a real time clock powered by said first battery and coupled with said CPU;

d. a sensor circuit being electronically coupled with said CPU and being adapted for sensing a condition in the well bore;

e. non-volatile memory capable of storing said sensed condition, wherein said non-volatile memory is coupled to said CPU;

f. a second battery having a second voltage greater than said first voltage; and g. wherein the CPU is programmed to record a sensed condition in the wellbore at a first time and subsequently monitor for said sensed condition at a later second time and upon detection of said sensed condition at the second time, causing said second battery to be electronically coupled to said detonator.

21. The system of claim 20, wherein said sensor is a pressure sensor.

22. The system of claim 20, wherein said sensor is a temperature sensor.

23. The system of claim 20, wherein said sensor is an electromagnetic wave sensor.

24. The system of claim 20, wherein said sensor is an a gamma ray sensor or a casing collar locator (CCL).

25. The system of claim 20, further comprising a second sensor circuit being electronically coupled with said CPU and being adapted for sensing a second condition in the well bore, wherein the CPU is programmed to record the second sensed condition in the wellbore and subsequently monitor for said second sensed condition and upon said subsequent measuring of said first and second sensed conditions, causing said second battery to be electronically coupled to said detonator.

26. The system of claim 20, further comprising a load cell being electronically coupled with said CPU and adapted to respond to shock waves propagated down a tool string.

27. The system of claim 20, further comprising a motion sensor being electronically coupled with said CPU and adapted to detect shock waves non-electrically propagated down a tool string.

28. The system of claim 27, further comprising a plurality of pipe joints forming a tool string which carries said system.

29. The system of claim 27, further comprising a non-conducting wire forming a tool string which carries said system.

30. The system of claim 20, further comprising an electrical shunt electrically connected between said second battery and said detonator.

31. The system of claim 27, wherein said motion sensor comprises an accelerometer.

32. The system of claim 27, wherein said motion sensor comprises a mechanical motion detector.

33. The system of claim 27, wherein said motion sensor comprises a casing collar locator (CCL) adapted to detect motion past pipe joint collars.

34. The system of claim 27, wherein said motion sensor comprises a digital magnetic measurement device and a fixed magnetic, wherein said digital magnetic measurement device is disposed to detect motion in the long axis of the tool.

35. A method for controlling detonation of explosives in a well bore, said method comprising the steps of:

a. providing a trigger system having a central processing unit (CPU), memory and at least one sensor disposed for measuring at least one downhole condition;

b. running said trigger system into the well bore and measuring at least one downhole condition at a desired location of perforation;

c. measuring the time required to run the trigger system from a first reference point to a second reference point, wherein the sensor is positioned adjacent the desired location of perforation when the triggering system is at said second reference point;

d. withdrawing the trigger system and programming a detonation time window into the CPU based on the measured time;

e. attaching a detonator to the trigger system;

f. running the detonator and trigger system into the well bore;

g. during the step of running the detonator and trigger system into the well bore, measuring the time from the first reference point to the second reference point; and h. arming the detonator only after a period of time has elapsed during step g that is at least equal to or longer than the measured time of step c.

36. The method of claim 35, wherein the detonator and trigger system are run into the wellbore on a physical deployment line, and further comprising the step of propagating an energy wave down the physical deployment line and detecting the propagated energy adjacent the trigger system.

37. The method of claim 36, wherein arming occurs only after the propagated energy has been detected.

38. The method of claim 36, wherein the propagated energy is transmitted as discreet shockwaves that represent a control signal.

39. The method of claim 38, wherein the control signal overrides the elapsed time requirement of step h and immediately arms the detonator.

40. The method of claim 38, wherein the control signal provides control instruction to the CPU.

41. The method of claim 40, wherein said control instruction is a firing signal and said detonator is fired following receipt of the firing signal by the CPU.

42. The method of claim 35, wherein said measured downhole condition is temperature.

43. The method of claim 35, wherein said measured downhole condition is pressure.

44. The method of claim 35, wherein said measured downhole condition is gamma ray energy.

45. The method of claim 35, wherein said downhole conditions are determined at the desired location of perforation.

46. The method of claim 35, wherein at least two downhole conditions are measured at the desired location of perforation.

47. The method of claim 35, wherein step b includes the measuring of the time required to run the system into the wellbore until a desired location of perforation has been reached.

48. The method of claim 47, wherein the step of arming the detonator occurs only once a period of time has elapsed during step f that is at least equal to or longer than the measured time of step c.

49. The method of claim 40, wherein said control instruction is an arming signal and said detonator is armed for firing following receipt of the arming signal by the CPU.

50. A method for controlling detonation of explosives in a well bore, said method comprising the steps of:

a. providing a trigger system having a central processing unit (CPU), memory and at least one sensor disposed for measuring at least one downhole condition;

b. running a sensor into the well bore and measuring at least one downhole condition at the desired location of perforation;

c. as the sensor is being run into the well, measuring a reference time between a first reference point and a second reference point, wherein the sensor is positioned adjacent the desired location of perforation at said second reference point;

d. withdrawing the sensor and programming a detonation time window into the CPU based on the measured reference time;

e. attaching a detonator to the trigger system;

f. running the detonator and trigger system into the well bore;

g. during the step of running the detonator and trigger system into the well bore, measuring the time from the first reference point to the second reference point; and h. arming the detonator only after a period of time has elapsed during step g that is at least equal to or longer than the measured time during step c.

51. The method of claim 50, further comprising the step of identifying a maximum elapsed time period which at a minimum is longer than the measured time during step c and programming the maximum elapsed time into the CPU, thereby establishing a time window.

52. The method of claim 51, further comprising the step of disarming the detonator if the elapsed time falls outside the time window.

* * * * *